United States Patent [19]

Wright

[11] 3,961,745

[45] June 8, 1976

[54] CENTRIFUGE APPARATUS

[75] Inventor: Herschel E. Wright, Santa Clara, Calif.

[73] Assignee: Beckman Instruments, Inc., Fullerton, Calif.

[22] Filed: Apr. 8, 1974

[21] Appl. No.: 458,837

[52] U.S. Cl. ..... 233/1 B; 233/26; 415/9; 74/572

[51] Int. Cl.[2] ..... B04B 7/06

[58] Field of Search ..... 233/1 B, 11, 26, 24, 233/27, 1 R; 64/28 R; 74/572; 415/9

[56] References Cited

UNITED STATES PATENTS

| | | | |
|---|---|---|---|
| 3,101,322 | 8/1963 | Stallman et al. | 233/24 |
| 3,819,111 | 6/1974 | Romanauskas et al. | 233/27 |

*Primary Examiner*—George H. Krizmanich
*Attorney, Agent, or Firm*—R. J. Steinmeyer; F. L. Mehlhoff

[57] ABSTRACT

In a centrifuge including a centrifuge rotor and a drive shaft for spinning the rotor at selected rotational speeds, a safety device adapted to prevent the rotor from attaining a rotational speed likely to cause the rotor to explode with a force that could not be contained within the centrifuge housing. The device includes a safety link handle assembly supported on the top of the rotor on the rotation axis thereof having an arm designed to rupture and depart from the handle assembly at a predetermined speed thereby creating an imbalance condition of such a magnitude that the rotor separates from the drive shaft and is thereby prevented from attaining a hazardous rotational speed.

7 Claims, 2 Drawing Figures

CENTRIFUGE APPARATUS

BACKGROUND OF THE INVENTION

The present invention relates in general to centrifuges and more particularly to an arrangement designed to prevent an ultracentrifuge rotor from exceeding a rotative speed which could result in a hazardous condition in the form of an uncontained explosion of the rotor.

Ultracentrifuges are generally intended for laboratory use and a rotor drive is arranged to make available any one of many possible speeds of rotation. Several sizes and types of rotors are generally supplied to accommodate for various types of work and different rotational speeds. Thus, one rotor may be adapted for one type of separating work and designed for speeds ranging up to 20,000 R.P.M., and another designed for higher speeds which may, for example, range up to 40,000 R.P.M. and another up to 50,000 R.P.M. There is always the possibility that an attendant may select the wrong rotor for the speed of the operation selected with the result that the safe speed of operation for a particular rotor is exceeded.

Because of the high rotative speeds employed in ultracentrifuge equipment, it is not possible to design all of the rotors employed with the centrifuge with a safety factor as high as might normally be considered good engineering practice, and therefore it is necessary to guard against excessive rotative speeds. Excessive speed may cause a rotor to burst or "explode" into a multitude of fragments and in the event of extremely high rotative energy forces, it is possible that some of these fragments may not be contained within the centrifuge housing and could likely injure an attendant or do great damage to the surrounding laboratory. It is desirable, therefore, to prevent the rotor from attaining a rotative speed at which such high energy is created.

In most instances, an electrical or mechanical speed control means is included as a part of the centrifuge or rotor and this will prevent a particular rotor from exceeding its designed speed. Examples of such safety devices are disclosed in U.S. Pat. Nos. 2,666,572 and 3,101,322, both of which are assigned to Beckman Instruments, Inc., the assignee of the present invention. There is, however, always the possibility that the electrical or mechanical speed control may fail to function properly and thereby permit the rotor to be driven at an excessive speed. The present invention is intended to provide a further or redundant measure of safety control over and above the normal type of speed control apparatus in order to prevent the occurrence of a hazardous explosive condition.

SUMMARY OF THE INVENTION

In accordance with the invention, there is provided an arrangement in a high speed centrifuge apparatus for creating an imbalanced condition in the rotor and drive shaft when the rotor exceeds a predetermined speed. To this end, there is provided a handle assembly attached to the rotor and including a safety link handle supported in a centerpiece extending upwardly from the rotor on the rotational axis thereof; the safety link handle having a pair of arms extending outwardly in opposite directions from the centerpiece and with one of the arms being so designed and constructed as to rupture at a predetermined rotational velocity of the rotor whereby the weight of the other arm causes the rotor and shaft to oscillate about its rotational axis creating an imbalance condition that causes the rotor to depart from the vertical drive shaft before it attains a speed sufficient to cause the rotor to "explode."

It is a general object of the present invention to provide an improved centrifuge apparatus having a safety device adapted to cause said rotor of the centrifuge to depart from its seat on the rotational shaft when the rotational speed thereof reaches a predetermined velocity, which velocity is substantially below that of the rotor burst speed.

It is another object of the present invention to provide a safety device of the above character which operates in response to the magnitude of centrifugal force applied to the device as the rotor reaches a predetermined rotational velocity.

Further objects and advantages of the invention will become apparent as the following description proceeds, and the features of novelty which characterize the invention will be pointed out with particularity in the claims annexed to and forming a part of this specification.

DESCRIPTION OF THE PREFERRED EMBODIMENT

Figure 1:
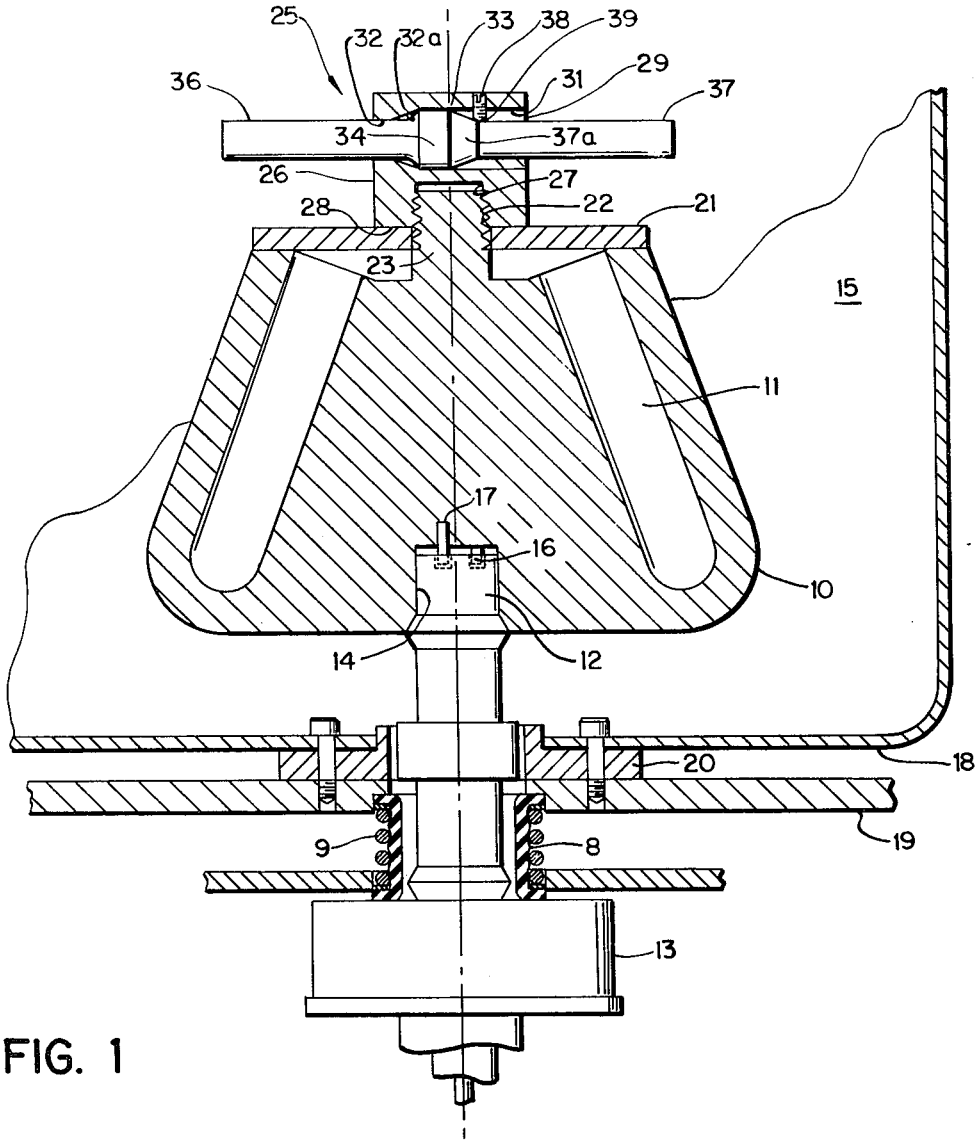
FIG. 1 is a vertical cross-sectional view of a rotor and a portion of the drive assembly of a centrifuge and illustrating a portion of the centrifuge chamber containing the rotor.

The apparatus illustrated in FIG. 1 includes a centrifuge rotor 10 having a plurality of sample receiving wells 11. A vertically extending shaft 12 is carried by a journal mounting 13 and is adapted to be driven by an electrical motor (not shown) through suitable gearing (not shown). The lower end of the rotor 10 has a socket opening 14 which accommodates the upper end of the drive shaft 12. The shaft also carries an eccentric driving pin 16 adapted to extend into driving relationship with a pin 17 which is fixed to the rotor. The rotor is normally enclosed within a chamber 15 which may be suitably sealed to provide a vacuum therein and which may be suitably refrigerated in order to maintain a predetermined temperature therein. The top (not shown) of the chamber is removable is order to provide access to the rotor.

The lower wall 18 of the chamber may be secured to the wall 19 of the outer housing which may also serve as a vacuum chamber. A collar 20 supports the lower wall 18 of the chamber 15 above the housing 19. A vacuum sealing member 8 formed of rubber or the like extends between the wall 19 and the journal mounting 13 and is expanded by compression spring 9 to hold its end faces in sealing engagement with the cooperating metal surfaces.

It should be noted, that the coupling between the rotor and the drive shaft 12 is not a locked coupling and that the rotor 10 merely rests on the upper end of the drive shaft and is driven by the pins 16 and 17. The rotor is free to disengage from the drive shaft if moved in the vertical direction.

The rotor is provided with a lid member 21 having a hole 22 formed centrally therein and adapted to slide over a central stud 23 formed on the rotor and extending upwardly along the rotational axis thereof. The lid is retained in place above the container receiving wells 11 and mates with the outer edge surfaces of the rotor to seal the rotor in these regions.

The lid 21 is retained on the rotor by the hole 22 and by a handle and safety link assembly, generally designated 25, which includes a centerpiece 26 having a threaded cavity 27 adapted to receive the threaded stud 23 extending upwardly from the rotor. The centerpiece is turned down onto the lid 21 so that the lower surface 28 of the centerpiece abuts the upper surface of the lid and forces the lid downwardly against the rotor.

As will be noted, the centerpiece 26 is provided with a hole 29 formed completely therethrough in a direction substantially normal to the axis of rotation of the rotor. In the preferred embodiment, the hole 29 is formed of a relatively large diameter section 31, extending substantially through a major portion of the centerpiece and is then necked down at 32*a* to form a smaller diameter section 32 through the remaining portion of the centerpiece.

Positioned in the hole 29 is a safety link handle, designated by numeral 33, which is formed of a bar of metal stock such as aluminum of stainless steel. The safety link handle is provided with a central portion 34 having a diameter or circumference substantially mating with the large diameter section 31 of the hole so that it will fit snugly into the hole. Extending outwardly from opposite sides of the central portion are arms 36 and 37 which protrude outwardly through the smaller and larger sections of the hole through the centerpiece. As will be noted, the arm 36 is of greater circumference or diameter than the arm 37. The arm 36 also extends through the small diameter section of the hole through the necked down region 32*a* of the centerpiece. Arm 37 extends outwardly through the larger diameter section of the hole and is substantially smaller in diameter than the more bulkier arm 36. It will also be noted that the central portion 34 of the safety link handle is not mounted directly along the rotational axis of the rotor, but is positioned well within the larger section 31 of the hole 29 and abuts against the necked down portion 32*a* of the hole so that it cannot be moved further into the hole, i.e., the central portion cannot be moved, as indicated in the drawing, further to the left within the hole.

The safety link 33 is asymmetrically formed in this embodiment and so designed as to be rotationally balanced about the rotational axis of the rotor when the link is positioned entirely within the hole 29 as far as it is permitted to move. It will be noted that the small diameter arm 37 is substantially longer than the shorter more bulkier arm 36 and the link is designed so that the weight of the link to the right of the rotational axis, as shown in FIG. 1, is substantially equal to the weight of the portion of the link to the left of the rotational axis, including the larger arm 36 and that part of the central portion 34 located to the left of the rotational axis. In the preferred embodiment of the invention, the safety link handle 33 is retained within the hole 29 by means of a set screw 38 extending through the top of the centerpiece into the hole 29 and abutting against a beveled section 37*a* of the smaller diameter arm 37 of the safety link.

The size of the arm 37 is so designed that the forces or stresses created when the rotor reaches a predetermined rotational speed will cause the arm to fail or rupture near the joint 39 between the beveled portion of the arm and the arm 37. The smaller diameter arm 37 is designed to fail at a speed substantially above the rated speed of the rotor, but well below the speed at which the rotor will actually burst or explode into a plurality of fragments that cannot be contained within the centrifuge housing. Thus, for example, if the rotor is rated at a rotational speed of 50,000 R.P.M. and will explode at, for example 70,000 R.P.M., the smaller arm 37 may be designed so that the forces created by the rotation thereof will be sufficiently great at perhaps 60,000 R.P.M.'s to cause the smaller arm 37 to rupture from the central portion 34 of the safety link. When the arm 37 ruptures it departs unimpeded through the large diameter section 31 of the hole 29. When this occurs, the more substantial arm 36 and the remaining central portion of the safety link which are positioned substantially on one side of the rotational axis of the rotor create an imbalance condition which immediately causes the rotor and its drive shaft to oscillate about the rotational axis to such an extent that the rotor is caused to disengage completely from the drive shaft. At this speed, such as 60,000 R.P.M.'s, the rotor will fly off the end of the drive shaft and thrash around within the chamber but will be retained within the chamber without fragmenting and throwing fragments out through the chamber and housing where they could possibly do injury to an attendant.

A tested embodiment of the invention utilized a safety handle link formed of "60–61" aluminum alloy, having a smaller arm 37 of a diameter of 18.7 mm. and a length of 122 mm. This safety link was attached to an aluminum rotor having a rated rotational speed of 50,000 r.p.m.'s and which would burst or explode at around 72,000 R.P.M.'s. The link was so designed as to rupture between 59,000 and 61,000 R.P.M.'s in the event all other safety speed controls failed. In the tested embodiment, the safety controls were purposely made to fail and the rotor exceeded the 50,000 R.P.M. rated speed. When the rotor reached the speed of approximately 60,000 R.P.M.'s, the smaller diameter arm 37 of the safety link ruptured and the oscillations of the rotor and drive shaft immediately caused the rotor to separate from the drive shaft. The rotor bounced and thrashed around the chamber where it did substantial damage to itself and the chamber, but was retained therein. While the rotor departs at high speed from the drive shaft and does created a great amount of energy, which will undoubtedly damage the interior of the chamber and the drive shaft, it does not reach a rotational speed that might not be contained within the rotor chamber or at least within the vacuum chamber of the housing. If the tested rotor were permitted to continue unimpeded to the rotational energy created at approximately 72,000 R.P.M.'s, the rotor would actually "explode" or burst into multiple fragments which, at this energy level, could possibly penetrate entirely through the centrifuge housing or lid of the device and be thrown at high velocity outside the centrifuge.

Figure 2:
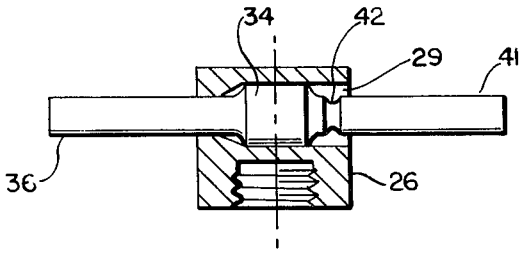
FIG. 2 is a fragmentary cross-sectional view of another embodiment of the handle and safety link assembly.

As will be seen in FIG. 2, there is shown a second embodiment of the invention in which the safety link handle is similar to that shown in FIG. 1. However, in this embodiment, the arm 41 is provided with a circumferential groove or neck 42 of reduced diameter. The neck 42 has the lowest tensile strength of any portion of the arm 41 and, as the centrifugal force of rotation increases, it is this portion of the arm that will fail or rupture. It is possible to design the arms 36 and 41 of the safety link handle in this embodiment to be approximately the same size and to design the circumferential groove or neck 42 so that it will rupture at approximately any predetermined rotational speed of the rotor. In this embodiment, the tensile strength of the neck is selected so that, for a predetermined outward centrifugal force applied to the arm 41, the neck will break under the tensile forces to permit the arm to depart from the safety link handle thereby creating an imbalance condition in the same manner as described above with respect to the embodiment of FIG. 1. It is apparent that the breaking rupture speed may be easily controlled by controlling the diameter of the neck 42 of the arm in relation to the weight thereof in the outer extremities of the arm.

It will be evident that this apparatus provides another level of safety for these high energy ultracentrifuge rotors. It adds a new dimension to the overspeed safety profile for centrifuge rotors and, while substantial damage will occur to the centrifuge in the event this safety device must operate, it does prevent the high speed rotors from reaching a speed where they will explode or burst and thereby cause injury or damage to persons and property adjacent the centrifuge apparatus.

While in accordance with the patent statutes there has been described what at present is considered to be the preferred embodiments of the invention, it will be understood by those skilled in the art that various understood and modifications may be made therein without departing from the invention. For example, it is not absolutely essential that the hole 29 be round, or that the safety link arms be circular in cross-sectional configuration. It is possible that they may be rectangular and still provide the same safety features. It is, therefore, the aim of the appended claims to cover all such changes and modifications that fall within the true spirit and scope of the invention.

What is claimed is:

1. A high speed centrifuge apparatus comprising:

a rotor adapted to carry samples to be centrifuged;

a vertical drive shaft having an end thereof adapted for coupling to said rotor for rotating said rotor on the rotational axis of said shaft;

a handle assembly attached to said rotor, said handle assembly including, a centerpiece positioned on the rotational axis of said rotor and extending outwardly from said rotor on the opposite side thereof from said drive shaft, said centerpiece having a hole therethrough normal to the axis of rotation, a safety link handle having a central portion fitting snugly in said hole in said centerpiece and two arms extending outwardly from opposite sides of said central portion through the openings in said hole in said centerpiece, said safety link handle being proportioned so that it is balanced when rotated with said rotor, means for retaining said safety link handle within said hole in said centerpiece, and one of said arms of said safety link having a section thereof close to said central portion designed and constructed of reduced tensile strength so as to withstand a rotational force less than the other arm and to rupture at a predetermined rotational velocity of said rotor whereby the outwardly extending portion of said one arm departs through said hole in said centerpiece thereby creating an imbalance condition causing said rotor and shaft to oscillate about the rotational axis thereby causing said rotor to depart from said vertical drive shaft.

2. The high speed centrifuge apparatus defined in claim 1 wherein hole in said centerpiece is of a first diameter for a major portion of its extent through said centerpiece and being necked down to a smaller diameter for the remaining portion of its extent through said centerpiece and said central portion of said safety link handle fits snugly within said larger diameter portion of said hole with said arms of said safety link handle extending outwardly through the openings in said hole in said centerpiece.

3. The high speed centrifuge apparatus defined in claim 2 wherein said one arm of said safety link handle is formed relatively smaller in cross-section than the other arm and said other arm extends from said central portion through said smaller diameter portion of said hole in said centerpiece.

4. The centrifuge apparatus as defined in claim 2 wherein said means for retaining said safety link handle within said hole in said centerpiece is a set screw abutting against a portion of said central portion of said safety link and said central portion abuts against said necked-down portion of said hole.

5. The centrifuge apparatus defined in claim 1 in which said portion of reduced tensile strength on said one arm of said safety link is a circumferential groove at the end thereof close to said central portion, said circumferential groove around said one arm thereby reducing the cross-sectional area of said one arm at said groove so that it will rupture under tension created by centrifugal forces at a predetermined rotational velocity of said rotor.

6. The centrifuge apparatus as defined in claim 1 in which said safety link handle is asymmetrically proportioned but is rotationally balanced within said hole in said centerpiece.

7. A high speed centrifuge apparatus comprising:

a rotor adapted to carry samples to be centrifuged, a drive shaft having an end thereof adapted for coupling to said rotor for rotating said rotor about the rotational axis of said shaft, a lid member having a central hole formed therethrough, a threaded stud extending upwardly from said rotor and adapted to receive said hole in said lid to position said lid on said rotor, a centerpiece having a threaded central cavity adapted to be threaded onto said stud of said rotor to tighten said lid onto said rotor, said centerpiece being positioned on the rotational axis of said rotor and extending outwardly from said rotor on the opposite side thereof from said drive shaft, said centerpiece having a hole therethrough normal to the axis of rotation;

a safety link handle having a central portion fitting snugly in said hole in said centerpiece and two arms extending outwardly from opposite sides of said central portion through the openings in said hole in said centerpiece, said safety link handle being proportioned so that it is balanced when rotated with said rotor, means for retaining said safety link handle within said hole in said centerpiece, and one of said arms of said safety link having a section thereof close to said central portion designed and constructed of reduced tensile strength so as to withstand a rotational force less than the other arm and to rupture at a predetermined rotational velocity of said rotor whereby the outwardly extending portion of said one arm departs through said hole in said centerpiece thereby creating an imbalance condition causing said rotor and shaft to oscillate about the rotational axis thereby causing said rotor to depart from said vertical drive shaft.

* * * * *